US011952889B2

(12) United States Patent
Yang

(10) Patent No.: US 11,952,889 B2
(45) Date of Patent: Apr. 9, 2024

(54) SYSTEM AND METHOD FOR IMPROVING THE EXPLOITATION OF A WELLBORE

(71) Applicant: INVISENSING.IO, Cachan (FR)

(72) Inventor: Feng Yang, Palaiseau (FR)

(73) Assignee: INVISENSING.IO, Cachan (FR)

( * ) Notice: Subject to any disclaimer, the term of this patent is extended or adjusted under 35 U.S.C. 154(b) by 244 days.

(21) Appl. No.: 17/607,550

(22) PCT Filed: May 7, 2020

(86) PCT No.: PCT/FR2020/050761
§ 371 (c)(1),
(2) Date: Oct. 29, 2021

(87) PCT Pub. No.: WO2020/225515
PCT Pub. Date: Nov. 12, 2020

(65) Prior Publication Data

US 2022/0243587 A1 Aug. 4, 2022

(30) Foreign Application Priority Data

May 7, 2019 (FR) ..... 1904788

(51) Int. Cl.
*E21B 47/135* (2012.01)
*E21B 43/12* (2006.01)

(52) U.S. Cl.
CPC ..... *E21B 47/135* (2020.05); *E21B 43/12* (2013.01)

(58) Field of Classification Search
CPC ..... E21B 47/135; E21B 43/12
See application file for complete search history.

(56) References Cited

U.S. PATENT DOCUMENTS

| | | | | |
|---|---|---|---|---|
| 7,940,389 | B2 | 5/2011 | Rogers et al. | |
| 9,075,155 | B2 | 7/2015 | Luscombe et al. | |
| 2005/0094129 | A1 | 5/2005 | MacDougall | |
| 2010/0038079 | A1 | 2/2010 | Greenaway | |
| 2010/0085572 | A1* | 4/2010 | Hartog | G01D 5/35383 356/478 |
| 2011/0194806 | A1* | 8/2011 | Hartog | G01C 9/06 33/304 |

(Continued)

FOREIGN PATENT DOCUMENTS

| | | |
|---|---|---|
| WO | 2009092436 | 7/2009 |

OTHER PUBLICATIONS

Lucas, Jim. "What is Electromagnetic Radiation?" Live Science, Mar. 13, 2015. Retrieved from the Internet: https://www.livescience.com/38169-electromagnetism.html.

(Continued)

*Primary Examiner* — Robert E Fuller
(74) *Attorney, Agent, or Firm* — Pearne & Gordon LLP

(57) ABSTRACT

A method (1000) of improving the operation of a wellbore (1), said wellbore (1) including a drill pipe (2) in which a fluid (3) circulates and an optical fiber (5) positioned outside the drill pipe (2). The circulation of said fluid (3) is controlled at least in part by an outlet valve (4*a*) and/or an injection valve (4*b*). The method includes steps of generating (100) two digital orthogonal backscatter signals from at least one light signal, preferably polarized, injected into said optical fiber (5), and controlling (400) the opening of injection and/or outlet valves (4) depending on the two digital orthogonal backscatter signals.

18 Claims, 7 Drawing Sheets

(56) References Cited

U.S. PATENT DOCUMENTS

| | | | | |
|---|---|---|---|---|
| 2011/0229071 | A1* | 9/2011 | Vincelette | E21B 43/2406 385/13 |
| 2011/0308788 | A1 | 12/2011 | Ravi et al. | |
| 2012/0067118 | A1 | 3/2012 | Hartog et al. | |
| 2015/0020598 | A1* | 1/2015 | Wang | E21B 47/135 73/705 |

OTHER PUBLICATIONS

International Search Report & Written Opinion (with translation) in PCT/FR2020/050761 dated Sep. 14, 2020, 20 pages.

Muggeridge, et al. "Recovery rates, enhanced oil recovery and technological limits." Philosophical Transactions of The Royal Society. vol. 372, Issue 2006. Jan. 13, 2014. 25 pages.

Fabre, et al. "Severe Slugging in Pipeline/Riser Systems." 62nd Annual Technical Conference and Exhibition of the Society of Petroleum Engineers. Sep. 27-30, 1987. pp. 113-120.

* cited by examiner

SYSTEM AND METHOD FOR IMPROVING THE EXPLOITATION OF A WELLBORE

The invention relates to the field of underground exploitation, such as oil exploitation, and more particularly to the improvement of wellbore operations. The invention relates to a method of improving the operation of a wellbore. The invention also relates to a system for improving the operation of a wellbore.

PRIOR ART

Drilling has been used for years to exploit underground resources. Historically, drilling has made it possible to find and exploit resources such as water. Then, over the years, drilling techniques developed with the exploitation of other resources such as oil and gas.

The exploitation of a resource by drilling generally comprises four phases. A first exploration phase for locating and evaluating the contents of the future well, leading to predictions of production volumes. A second phase, called the start-up phase, corresponding to drilling and the beginning of production. A third plateau phase during which production is stable, with production generally being a function of well size (volume). Finally, a fourth and last phase corresponds to the decay period during which production declines and may lead to the end of the operation of the well, or even to a premature stop of wellbore operations. Indeed, wellbore recovery rates are relatively low, particularly for oil wells that are less mobile and denser than gas wells. These low recovery rates can result in early wellbore shutdown and wellbore productivity or operating loss.

The first three phases of a wellbore operation are the most closely monitored and controlled. Indeed, actors in the field are constantly seeking to increase production, monitor drilling conditions while controlling the proper execution and progress thereof. Current techniques using sensors to record the physical characteristics of a wellbore such as magnetic, acoustic, or temperature characteristics have been implemented to detect the location of defects or degradation of a wellbore. Thus, the data collected allows for characterization of the preparation phase and monitoring and control of the start-up phases. However, these techniques do not allow for improved operation of a wellbore in the decay phase.

Detection and monitoring systems have been developed following the use of optics and in particular fiber optics in the field of underground exploitation. Indeed, optical fibers, commonly used in telecommunication, have been the object of a new interest, that of vibration detection and acoustic energy capture along the optical fiber, allowing various and diversified industrial applications. By way of example, fiber optics have been used to detect a leak in a pipeline or to monitor a gas storage site.

For example, document US2010/0038079 proposes an optical fiber in order to monitor equipment downhole in a wellbore. Fiber optics are used to detect vibrations associated with the equipment. The analysis of these vibrations and more particularly of the stress then makes it possible to define the state of wear of the equipment. The document US2011/0308788 provides for the use of an optical fiber to monitor the deformation of cement in a wellbore. This document also uses the study of stress on the optical fiber and temperature measurement to determine the cement health by Raman, Brillouin, and/or Rayleigh backscatter. However, these documents US2010/0038079 and US2011/0308788 focus on information coming back from the equipment through the optical fiber, which does not allow for the improvement of the wellbore operation.

Fiber-optic measurement systems using the principle of reflectometry such as OTDR (Optical Time Domain Reflectometer in Anglo-Saxon terminology or Réflectomètre optique temporel in French) have been used to determine, via the analysis of reflectometry of the optical fiber, parameters (for example temperature, deformation) that can degrade the performance of a wellbore as illustrated by way of example in document US2012/0067118 However, these systems are insufficient because they do not allow the operation of a declining wellbore to be improved. OFDR (Optical Frequency Domain Reflectometry in Anglo-Saxon terminology or Réflectomètre optique en domaine de fréquences in French) can be used to provide data similar to OTDR over shorter distances, in the order of tens of meters, with a higher resolution than OTDR. However, it is rare that the distance between the surface and the bottom of the well is of the order of ten meters.

Devices that analyze a single physical parameter selected from temperature, acoustics, vibration, or pressure have been developed to increase the accuracy and reliability of wellbore monitoring. For example, document WO2009092436 discloses a fiber-optic distributed temperature sensing system. A laser pulse is pulsed into the optical fiber and propagated along the length thereof. This system allows the interaction properties between the material and the wave to be recorded, allowing the qualitative parameters of drilling to be monitored and controlled. However, this system does not allow the production of a wellbore to be increased, especially during its decline phase.

Document U.S. Pat. No. 9,075,155 discloses a system equipped with an optical fiber to monitor and control microseismic events that may occur during drilling. To this end, this document presents the analysis of Rayleigh backscatter to obtain acoustic signals to determine the distance, direction, or intensity of seismic activity. Indeed, changes in the intensity of the Rayleigh backscatter result in the occurrence of seismic signals. This system therefore makes it possible to monitor that the drilling process is running smoothly during the start-up, plateau, and even decline phases. However, this system does not allow the performances to be optimized or the production of gas or oil wells to be stabilized, especially during the decline phase, but only microseismic events to be measured. In addition, fiber optics can only be used in addition to traditional acoustic sensors to increase the spatial coverage of the measurements. Moreover, it needs to be placed in the direction from which the acoustic signal comes, which drastically reduces the fields of application of the optical fiber for distributed acoustic detection.

Finally, document U.S. Pat. No. 7,940,389 discloses the use of an optical fiber for sensing distributed pressure in fluids. Detection of changes in the polarization states of the backscattered light result in changes in birefringence proportional to the pressure of the fluid in which the optical fiber is immersed. This makes it possible to measure the flow of a fluid or to determine the location of an interface between two fluids of different densities. This technique is insufficient to improve the production of a wellbore, and it is not compatible with oil production environment.

Thus, fiber-optic distributed measurements are used for monitoring or controlling physical parameters in a wellbore. However, these methods are not used to improve the operation of a wellbore, especially when production decreases during the end-of-life of wellbores or during the decay period.

Several methods have been proposed to increase hydrocarbon recovery (EOR: Enhanced Oil Recovery in Anglo-Saxon terminology or récupération assistée d'hydrocarbures in French) in order to increase or maximize the recovery factor. These techniques suggest injecting a fluid into a reservoir to create a pressure gradient and allow for an increase, for example by displacement of the hydrocarbons, in the recovery factor (Recovery rates, enhanced oil recovery and technological limits, Ann Muggeridge, 2012, Philosophical transactions of the royal society). However, this technique requires the use of a large volume of fluid and the study of permeability beforehand. This technique is therefore costly, complex, and time-consuming.

Furthermore, oil production wells in the middle and end of their life cycle regularly experience "slugging" (in Anglo-Saxon terminology, or écoulement á bouchons in French) behavior, which is an undesirable multiphase flow regime that is detrimental to the wellbore. Large oscillations in pressure and production rate due to the simultaneous presence of liquid and gas phases cause problems of infrastructure damage, safety, and decrease the productivity of the well (Fabre, Peresson, Corteville, Odello & Bourgeois, 1990). In the most severe cases, "slugging" wells must be shut down while the reservoir still contains significant oil reserves.

Therefore, there is a need for new methods and systems capable of addressing the problems caused by existing methods and optimizing the performance of wellbores, preferably for declining or end-of-life oil and gas wells.

Technical Problem

The invention therefore aims to overcome the disadvantages of the prior art. In particular, the invention aims to provide a method for improving the production of a wellbore, said method being fast, safe, and simple to implement even when a drilling infrastructure is already installed. The method according to the invention also makes it possible to stabilize and increase the production of a wellbore, while controlling costs, in particular thanks to the absence of modification of the wellbore infrastructure.

The method according to the invention allows the production of a wellbore to be optimized, especially of a wellbore in the decline phase. The method according to the invention allows premature closing of a wellbore to be avoided. In addition, the method according to the invention allows for increased recovery rates of the wellbores.

The invention further aims to provide a system for improving the operation of a wellbore, said system facilitating measurements, improving the safety of the wellbore, and allowing reliable and accurate results to be obtained.

BRIEF DESCRIPTION OF THE INVENTION

To this end, the invention relates to a method of improving the operation of a wellbore, said wellbore including a drill pipe in which a fluid circulates and an optical fiber positioned outside the drill pipe, the circulation of said fluid being controlled at least in part by at least one outlet and/or injection valve, said method including the steps of:

- Generating two digital orthogonal backscatter signals from at least one light signal, preferably polarized, injected into said optical fiber, and
- Controlling the opening of at least one outlet and/or injection valve depending on the two digital orthogonal backscatter signals.

The implementation of this method makes it possible to optimize the performance of wellbores, preferably gas and oil wellbores, particularly during the decay period. This method makes it possible to use the information generated via the optical fiber in order to stabilize and regulate the flow of a fluid, especially when the wellbore conditions are unknown or not well known. In particular, the method makes it possible, via the two digital orthogonal backscatter signals, to facilitate distributed pressure measurements using fiber optics and enhance monitoring especially during the production decline phase.

In addition, this method also makes it possible, thanks to the opening control, to eliminate the poorly stable or unstable pressure oscillations that can be observed along the length of the well, and thus to stabilize and increase production. The present invention also allows a better control of the oil/gas ratio at the exit of the wellbore, and this allows the subsequent separation phase of these components to be optimized. Indeed, these values must be in a particular range for the separation to be effective.

It is simple, fast, and can be easily implemented even within an existing infrastructure. In addition, the method is safe and secure both for the operators and the measurements performed. Furthermore, the method allows for reliable and accurate results.

In addition, most wells do not have downhole pressure sensors and when present, their maintenance requires costly operations over the long term. However, wells are usually equipped with much more robust fiber-optic cables set in cement, used to transmit data from the bottom of the well to the surface.

According to other optional features of the method, the latter may optionally include one or more of the following features, alone or in combination:

- it further comprises an intermediate step of calculating values of fluid circulation parameters from the two digital orthogonal backscatter signals, and in that the step of controlling the opening of at least one valve is carried out depending on the circulation parameters obtained from the two digital orthogonal backscatter signals.
- the intermediate calculation step includes calculating distributed pressure values of the fluid circulating in the pipe from the two digital orthogonal backscatter signals, and in that the step of controlling the opening of at least one valve is carried out depending on the distributed pressure values obtained from the two digital backscatter signals. This is particularly advantageous because the method according to the invention allows distributed pressure information to be extracted without contact with the fluid. Advantageously, the method allows for continuous analysis at any point of the optical fiber without averaging data, which increases the resolution. Indeed, when the wellbore is deep, a single measurement at the bottom of the well is not sufficient to correctly assess the situation of the well and initiate the appropriate corrective measures. This also allows for pressure stabilization and fluid flow regulation, which in turn increases the life of the infrastructure and optimizes wellbore performance.
- the optical fiber is arranged to transmit data from the wellbore, preferably from the bottom of the wellbore, to the surface of said wellbore. Indeed, wellbores are usually already equipped with measuring equipment located at the bottom of the wellbore and the measurements of which are transferred to the surface via an optical fiber. With the optical fiber thus arranged to transmit data from the wellbore to the surface of said wellbore. This facilitates measurements and avoids the need for a new optical fiber. In this case, the method is advantageously configured to inject the light signal into said optical fiber during time periods in which the optical fiber does not transmit data.

the fluid circulation parameters are preferably selected from: distributed pressure, pressure average, pressure median, pressure variation, integral, or derivative, the calculating step comprises calculating a ratio of optical signal as a function of distance, this calculating step allows pressure criticality areas to be identified.

the calculation step includes comparing the intensity ratio as a function of distance with the detected pressure as a function of time. This allows the determination of distributed pressure variations and the accurate determination of criticality areas. Furthermore, this makes it possible to correlate the production of the wellbore with the distributed pressure.

the calculation involves calculating a variance of the optical signal intensity ratio for a segment of the tube as a function of time, this also allows the identification of pressure criticality areas.

it comprises storing, on a storage module, the results obtained at the end of each calculation step. This allows all the wellbore measurements, all the data collected by the optical fiber, and all the digital signals to be saved.

it comprises a step of calculating opening value of injection and/or outlet valves depending on the previously calculated fluid circulation parameters. These calculated outlet valve opening levels are used to compensate for particular pressure data, in order to improve or optimize wellbore operation and increase wellbore production.

The optical fiber has low intrinsic birefringence. Birefringence can be measured using a polarizer and an analyzer, by placing the optical fiber between these two elements and analyzing the interference that results from passing through the optical system comprised of the optical fiber, the polarizer, and the analyzer. Thus, low birefringence, quantified by the difference in refractive index for slow and fast propagation, will have an absolute value of less than 0.001.

the optical fiber is placed on the outer surface of the drill pipe. This allows for easier measurement and increased control. This also allows for the collection of reliable and accurate data. Furthermore, this allows the method to be implemented even with an existing and installed infrastructure.

the optical fiber is placed in the concrete surrounding the drill pipe. This allows for easier measurement and increased control. This also allows for the collection of reliable and accurate data.

it includes a step of controlled polarization of a light signal intended to be injected into the optical fiber. This makes it possible to distinguish the backscattered light in the different sections of the optical fiber and to obtain an indication of the pressure experienced by the fiber as a function of distance. This allows reliable and accurate data to be obtained in order to improve wellbore operation.

the generation step includes a step of separating a backscatter signal into two orthogonal backscatter signals. This facilitates for easier further processing of the backscatter data and use of the information supported by the optical fiber in order to stabilize the pressure and to stabilize and regulate the flow of a fluid.

the control step includes sending a signal for closing the injection valve. Preferably, the control step includes sending a signal for opening the outlet valve. This allows for automatic pressure stabilization, and stabilization and regulation of the flow of a fluid. In addition, it allows for increase life of the infrastructure and optimized wellbore performance.

it comprises a step of circulating the light signal. This allows, on the one hand, to inject the polarized light signal into the optical fiber, and, on the other hand, to collect the backscattered signal from the optical fiber.

Other implementations of this aspect include computer systems, apparatus and corresponding computer programs recorded on one or more computer storage devices, each configured to perform the actions of a method according to the invention. In particular, a system of one or more computers may be configured to perform particular operations or actions, especially a method according to the invention, by installing software, firmware, hardware or a combination of software, firmware or hardware installed on the system. In addition, one or more computer programs may be configured to perform particular operations or actions by means of instructions which, when executed by data processing equipment, cause the equipment to perform the actions.

According to another aspect, the invention further relates to an optical device for improving the operation of a wellbore, said wellbore comprising a drill pipe in which a fluid circulates and an optical fiber positioned outside the drill pipe, where the circulation of said fluid is controllable at least in part by at least one outlet valve and/or injection valve, said device for improving the operation of a wellbore comprising an optical device configured to generate two digital orthogonal backscatter signals from at least one light signal, preferably polarized, injected into said optical fiber, and a processing device configured to generate, from the two digital orthogonal backscatter signals, opening control data for the outlet valve and/or injection valve.

The design of a device capable of measuring pressure variations over several kilometers of an oil production well is a major technological breakthrough. Indeed, the device is sensitive to lateral stresses (such as flow pressure in the case of an oil well). In addition, the device exploits the phenomenon of birefringence, induced by lateral stresses.

According to other optional features of the device, the latter may optionally include one or more of the following features, alone or in combination:

the optical device is arranged at different wellbores. This allows for improved operation of several wellbores.

it is configured to control outlet and/or injection valves of several wellbores. This allows for improved operation of several wellbores.

the optical device includes a light source, at least one polarization controller, at least one circulator, and at least one detector. Thus, the optical device allows the generation of two digital orthogonal backscatter signals.

the circulator is configured to collect backscatter from the optical fiber, for example Rayleigh backscatter. The circulator allows the reception of the polarized light signal.

the detector is configured to detect the backscattered light signal and to transform the light signal into a digital signal, and preferably into two digital orthogonal backscatter signals. Thus, the detector makes it possible to detect two digital signals from the backscattered light signal.

the detector is configured to detect a first light signal and then a second light signal according to their electromagnetic field.

the optical device comprises a polarized splitter, said polarized splitter is configured to divide and separate the light beam comprising the "P" and "S" fields into two signals each including a polarization orthogonal to the polarization of the other signal so as to divide the light beam from the optical fiber into a light beam comprising the "P" field and a light beam comprising the "S" field. This allows the separation of the light beam according to the polarization state.

the detector may comprise at least one detector module preferably two detector modules configured to transform and convert the light signal into two electrical signals; said electrical signals being directed to a digitizer module configured to transform and convert the two electrical signals into two digital orthogonal backscatter signals. This allows two digital orthogonal backscatter signals to be obtained.

According to another aspect, the invention further relates to a system for improving the operation of a wellbore, said wellbore including a drill pipe in which a fluid circulates and an optical fiber positioned outside the drill pipe, where the circulation of said fluid is controllable at least in part by at least one injection and/or outlet valve, said system including a device for improving the operation of a wellbore according to the invention, and a regulating device configured to control the opening of the injection and/or outlet valve depending on the generated opening control data.

According to other optional features of the system, the latter may optionally include one or more of the following features, alone or in combination:

it comprises a plurality of optical devices, each in connection with one of a plurality of wellbores, thereby improving the operation of several wellbores it controls the injection and/or outlet valves of several wellbores, which also allows the operation of several wellbores to be improved.

Other advantages and features of the invention will appear upon reading the following description given by way of illustrative and non-limiting example, with reference to the appended figures.

Figure 1:
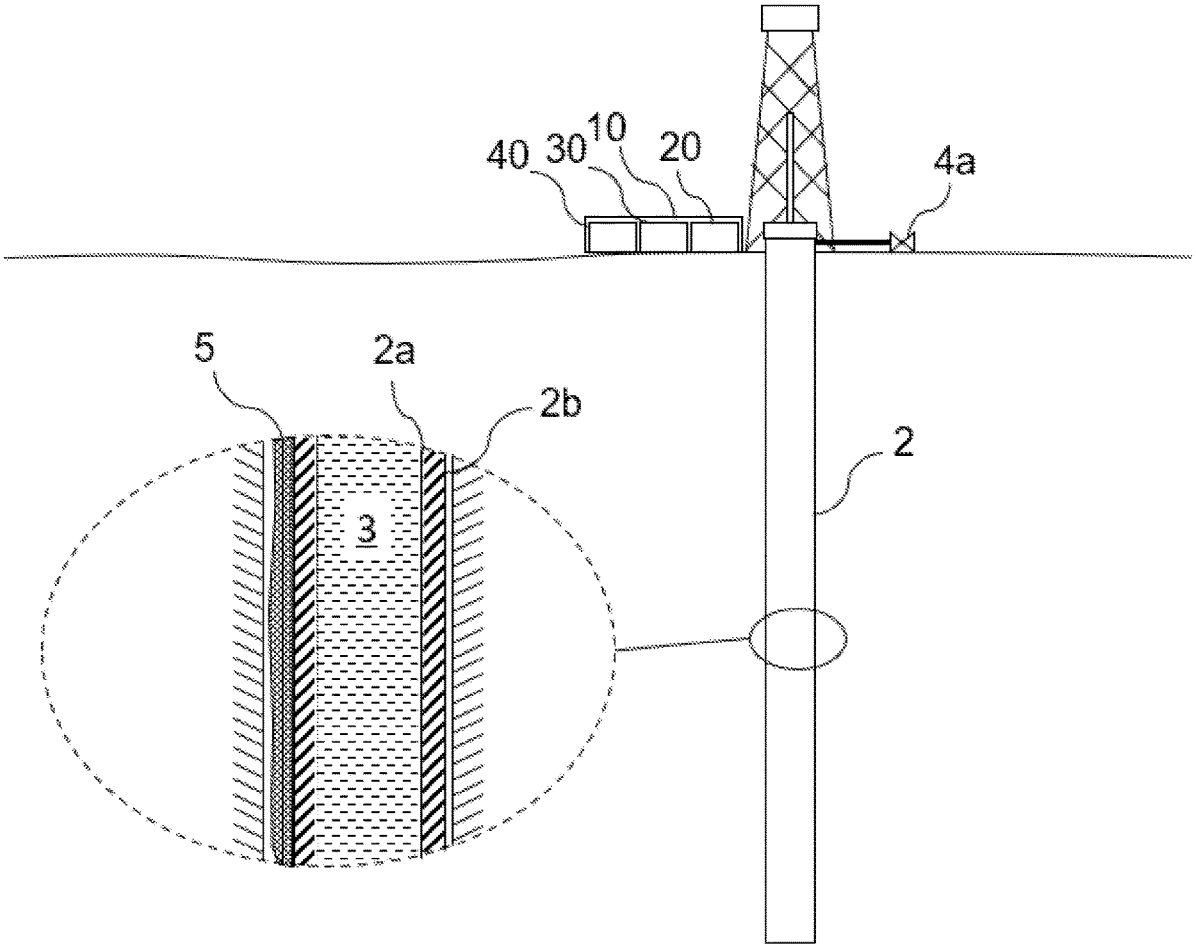
FIG. 1 shows a schematic of a system for improving the operation of a wellbore according to a first embodiment of the invention.

Aspects of the present invention shall be described with reference to flowcharts and/or block diagrams of methods, apparatus (systems) according to embodiments of the invention.

In the figures, the flowcharts and block diagrams illustrate the architecture, functionality, and operation of possible implementations of systems and methods according to various embodiments of the present invention. In this respect, each block in the flowcharts or block diagrams may represent a system, device, module, or code, which comprises one or more executable instructions for implementing the one or more specified logical functions. In some implementations, the functions associated with the blocks may appear in a different order than shown in the figures. For example, two blocks shown in succession may, in fact, be executed substantially simultaneously, or the blocks may sometimes be executed in reverse order, depending on the functionality involved. Each block in the flow diagrams and/or flowchart, and combinations of blocks in the flow diagrams and/or flowchart, may be implemented by special hardware systems that perform the specified functions or acts or perform combinations of special hardware and computer instructions.

DESCRIPTION OF THE INVENTION

By "exterior", within the meaning of the invention, is meant a space that does not belong to or is not part of a defined element. The exterior is preferably delimited by a surface, a wall, or a membrane. For example, a tubular member defined by an inner surface and an outer surface, has an interior delimited by the inner surface and an exterior delimited by the outer or exterior surface.

By "at least in part", within the meaning of the invention, is meant one or more elements or one or more actions that contribute to a whole or a same result or objective. Thus, an action that can be carried out by several actors is carried out in part by at least one of these actors.

By "light signal", within the meaning of the invention, is meant a transmission means which may be colored or not, fixed or intermittent, free or guided. Preferably, it is a signal guided in an optical fiber.

By "backscatter", within the meaning of the invention, is meant the fraction of the incident wave that is returned in the direction of emission of the incident wave.

By "birefringence" is meant the property of splitting an incident light ray into two light rays (refracted rays).

By "polarization", within the meaning of the invention, is meant the electrical induction vector. A controlled polarization can therefore advantageously correspond to a control of the electric induction vector. By "polarization state" is meant the temporal evolution of the electric induction vector.

By "orthogonal" or "orthogonal polarization", within the meaning of the invention, is meant, for example, the ability of the scalar product of two JONES vectors representing the polarization state of a light wave to cancel each other out, in other words, the polarization state represented by two vectors E1 and E2 is orthogonally polarized if E1*. E2=0, where * is the conjugate transpose operator. Moreover, two JONES vectors E1 and E2 are also orthogonal if the Hermitian scalar product is zero.

By "digital signal", within the meaning of the invention, is meant in particular a set of physical quantities or data represented by means of encrypted characters, by means of which the information is represented by a finite number of well-defined discrete values that one of its characteristics can have over time.

By "distributed pressure", within the meaning of the invention, is meant a physical quantity which expresses the pressure that is exerted at a plurality of points of an element and not at a particular and precise point of this element.

The terms "including" and "comprising" are used in an open-ended manner, and should therefore be interpreted to mean including, without limitation.

The term "coupled" or "connected" refers to an electrical, mechanical, thermal, electromagnetic, direct or indirect, moving or stationary connection. Thus, if a first device is coupled to a second device, this connection can be established via a direct or indirect connection via other devices and connections.

The term "waveguide" can refer to any element capable of guiding electromagnetic radiation to propagate along a defined path. Depending on the wavelength of the electromagnetic radiation to be transported through the waveguide, the waveguide may be an optical fiber, for example made of fused silica glass, to transport visible and infrared radiation.

By "substantially equal" or "substantially identical", within the meaning of the invention, is meant a value varying by less than 30% with respect to the compared value, preferably by less than 20%, even more preferably by less than 10%. When substantially identical is used to compare shapes, then the vectorized shape varies by less than 30% with respect to the compared vectorized shape, preferably by less than 20%, even more preferably by less than 10%.

By "process" "calculate,", "display", "extract", "compare", "measure", or more broadly "executable operation", within the meaning of the invention, is meant an action performed by a device or a processor unless the context indicates otherwise. In this regard, the operations relate to actions and/or processes of a data processing system, for example a computer system or an electronic computing device, which manipulates and transforms the data represented as physical (electronic) quantities in the memories of the computer system or other devices for storing, transmitting or displaying information. These operations may be based on applications or software.

By "accurate", "reliable", "precise", within the meaning of the invention, are meant repeatable and precise measurements, the accuracy of which is of the order of one meter or one centimeter. Furthermore, this means that the measurements are free of errors related to the measuring device.

By "essentially" or "essential", within the meaning of the invention, is meant at least 50% of the constitution, preferably at least 70% of the constitution, more preferably at least 90% of the constitution, even more preferably at least 95% of the constitution.

In the following description, the same references are used to designate the same elements.

In addition, the different features presented and/or claimed can be advantageously combined. Their presence in the description or in different dependent claims, does not exclude this possibility.

Current solutions to optimize oil and gas well performance such as enhanced oil recovery methods are generally time consuming, laborious, costly, inaccurate, and unreliable. In addition, they often require the use of expensive and risky equipment, particularly in the context of hydrocarbon drilling. In addition, current solutions to optimize wellbore performance are implemented during the productive wellbore life cycle including the preparatory, start-up, and plateau phases. Thus, there are few or no solutions to optimize wellbore performance during the decay period, when production declines.

The inventors have developed a new system for and a new method for improving the operation of a wellbore, especially during a decay period.

Thus, a wellbore benefiting from the proposed technology will see an increase in its production, thanks to continuous monitoring of the pressure distributed in the wellbore and control of the opening of at least one outlet valve or injection valve.

To this end, the invention is based on the capacity of a light signal, correctly processed, to deliver data about the environment of an optical fiber carrying the light signal and allowing in particular to trace physical characteristics linked to the wellbores. For example, a backscattered polarized light signal may include data about the pressure on the optical fiber. Preferably, the distributed measurement is configured to be responsive to pressure exerted transversely to its longitudinal axis. In addition, pressure differences within a wellbore can be indicative of wellbore conditions, instability within the wellbore, external variations.

The invention will be described in the context of a wellbore in which a fluid circulates and where little or no wellbore (reservoir) conditions are known, characterizing the wellbore decay period. The invention is not, however, limited to this example, and can find applications in the various phases of the life cycle of a wellbore.

According to a first aspect, the invention relates to a device 10 for improving the operation of a wellbore 1.

Such a device and wellbore are described in particular in FIG. 1. As illustrated in FIG. 1, a drill pipe 2 corresponds to a preferably tubular element for operating a wellbore, comprising an inner surface 2*a* and an outer surface 2*b*. The tubular member may be longer than the width and may be, for example, cylindrical or rectangular in shape. Furthermore, the drill pipe 2 according to the invention is preferably hollow. Advantageously, the drill pipe 2 is preferably made of concrete, metal, GRP (glass fiber reinforced polyester), sandstone, and can be surrounded by concrete for improved safety and resistance thereof to external elements.

During operation, the drill pipe 2 comprises a fluid 3 to be collected. Such a fluid 3 circulates inside the drill pipe 2 and preferably in its hollow space. The fluid 3 in the sense of the invention may correspond to any substances having a liquid or gaseous state. Preferably, the fluid 3 includes gas, oil, water, or mixtures thereof.

Furthermore, circulation of said fluid 3 is controlled at least in part by an outlet valve 4*a*. A valve 4*a* can correspond to any means for regulating a flow rate. Thus, it can be a mechanical valve, a solenoid valve, a gate valve, a flap valve, a ball valve, a plug valve, a butterfly valve, a knife gate valve, a piston valve, a two-way valve, a three-way valve, a rotary valve, an automatic valve, a discharge valve, a flush valve, a guard valve, a cut-off valve, an upstream valve, a downstream valve. An outlet valve 4*a* allows fluid to be extracted or discharged from the drill pipe. Furthermore, according to a particular embodiment, a valve 4 may be compatible with a digital, electrical, magnetic, or mechanical control, in a continuous or discontinuous manner. Preferably, the outlet valve 4*a* is positioned at the wellhead and even more preferably at the surface.

The drill pipe 2 has an optical fiber 5. Preferably, the optical fiber 5 is present in the form of a waveguide. An optical fiber generally consists of at least a core, an optical cladding, and a coating. In a particular embodiment, an optical fiber reinforcement and an optical fiber cladding may be provided. The optical fiber 5 is used to transport light signals between a light source and a receiver. In particular, the optical fiber 5 used by the system according to the invention and within the framework of the method according to the invention is an optical fiber 5 installed during the construction of the wellbore. Such an optical fiber is used in particular for the transmission of information from the bottomhole to the surface. This corresponds, for example, to the transmission of sensor data such as temperature measurements.

The core of the optical fiber 5 allows the optical signals to be transmitted between a light source and a receiver. The core can be made of glass or polymer and differs by its diameter. Thus, the optical fiber 5 according to the invention may correspond to a multimode optical fiber or to a single-mode optical fiber. Preferably, the optical fiber is a single-mode fiber, which allows only one mode of propagation to be transmitted. Because of the polarization, the invention is advantageously compatible with a single-mode fiber. Indeed, most wells are equipped with single-mode fibers connecting underground equipment with the surface. In addition, a single-mode fiber allows light signals to be transmitted over longer distances with fewer losses than multimode fibers. The size of the fiber is of little importance and the method according to the invention operates with a wide range of fibers. In particular, the size of the optical fiber may be selected from: 62.5/125 μm, 50/125 μm, or 9/125 μm.

Furthermore, a single-mode optical fiber carries two orthogonal sub-eigenmodes. These are two main polarization states. If the fiber is not perfectly circular, the two modes can propagate at different speeds (this is the definition of birefringence). These two modes correspond to two electromagnetic fields corresponding to a "fast" and a "slow" field, generally named "f" (fast) and "s" (slow). In our application, the optical fiber preferably has low intrinsic birefringence. The fast axis is defined by the direction of the application of the force, in the direction of the radius.

In this case, the "f" and "s" fields are orthogonal. The orthogonality is verified for example by the Jones vector and the Hermitian scalar product of the vectors of the two fields is then zero.

The light in the fast field will have a longer wavelength than the light in the slow field. As a result, the two fields "f" and "s" change phase with respect to each other as they propagate through the fiber. The two fields start out in phase (when the light signal enters the optical fiber), and then after changing phase over a certain distance along the fiber, they are in phase again. The distance over which this phase realignment takes place is called the "beat length".

Based on these observations, it is then possible to calculate the pressure, preferably the distributed pressure, of a waveguide from, for example, Rayleigh backscatter associated with a particular location and along the entire length of the optical fiber 5 to determine the operating conditions thereof for a wellbore, particularly in the decay (decline) phase.

Furthermore, the birefringence of a waveguide, and more specifically of the optical fiber 5, depends on two factors: the intrinsic birefringence of the optical fiber 5 and its induced birefringence.

Intrinsic birefringence is generally considered to be the birefringence of the optical fiber in the absence of any external influence on said optical fiber, such as externally applied stress and pressure, magnetic and electric fields, or temperature variation. For example, the intrinsic birefringence of the optical fiber is usually determined at a neutral pressure (for example atmospheric pressure). For an optical fiber, intrinsic birefringence results, for example, from inhomogeneity in the materials that make up the fiber; variations in the geometry of the fiber along its length; and stresses occurring in the core of the fiber in the absence of external influences. Optical fiber-induced birefringence is a change in the birefringence of the optical fiber caused by the application of pressure, either directly or indirectly, on the optical fiber.

In order to correlate the two digital orthogonal backscatter signals directly or more easily with the pressure exerted on said optical fiber 5, the optical fiber therefore preferably has low intrinsic birefringence so that the induced birefringence dominates the intrinsic birefringence.

Thus, the fiber may preferably have low intrinsic birefringence, and may therefore correspond to a standard telecommunication fiber, for example.

In general, an optical cladding surrounds the core of the optical fiber 5. The cladding allows for retention of the light waves while allowing circulation along the entire length of the fiber. In addition, cladding can be used to cause refraction. The cladding is made of silica or polymer such as polymethylmethacrylate (PMMA), or photonic crystals. Preferably, the cladding is made of silica, which reduces in particular the level of losses during the propagation of the light in the optical fiber. In addition, the cladding may comprise dopants such as germanium, aluminum, fluorine, erbium, ytterbium, thulium, or tellurium, which substitute for silicon to form an oxide that can modify certain properties of the fiber, in particular to amplify signals.

In addition, a polymer coating can surround the cladding and can be used to protect the optical fiber, in particular by absorbing any shocks that the optical fiber may undergo. The thickness of the coating is between 250 μm and 900 μm. In particular, the optical fiber 5 has an optical fiber cladding. Preferably, this cladding is structured. This improves the attachment of the optical fiber to the drill pipe.

The length of the optical fiber 5 can be of the order of the depth of a wellbore. For example, the minimum length is 1 km, preferably 2 km, and more preferably 3 km.

Furthermore, the optical fiber 5 is positioned outside the drill pipe 2. Thus, the optical fiber 5 is not part of the hollow space (that is to say the inside) of the drill pipe 2. The optical fiber 5 is placed on the outer surface 2*b* of the drill pipe 2, for example. Thus, the optical fiber 5 is in contact, preferably in direct contact, with the outer surface 2*b* of the drill pipe 2, which allows for improved sensitivity of the optical fiber. Furthermore, in the case where the drill pipe 2 is surrounded by concrete, the optical fiber 5 is placed in the concrete surrounding the drill pipe 2.

In particular, the invention aims to optimize yields for oil production wells in the middle of their life cycle. In this context, the invention can be implemented on an isolated wellbore as described in FIG. 1, but can very well be associated with other technologies of enhanced oil recovery (more commonly known as EOR).

Figure 2:
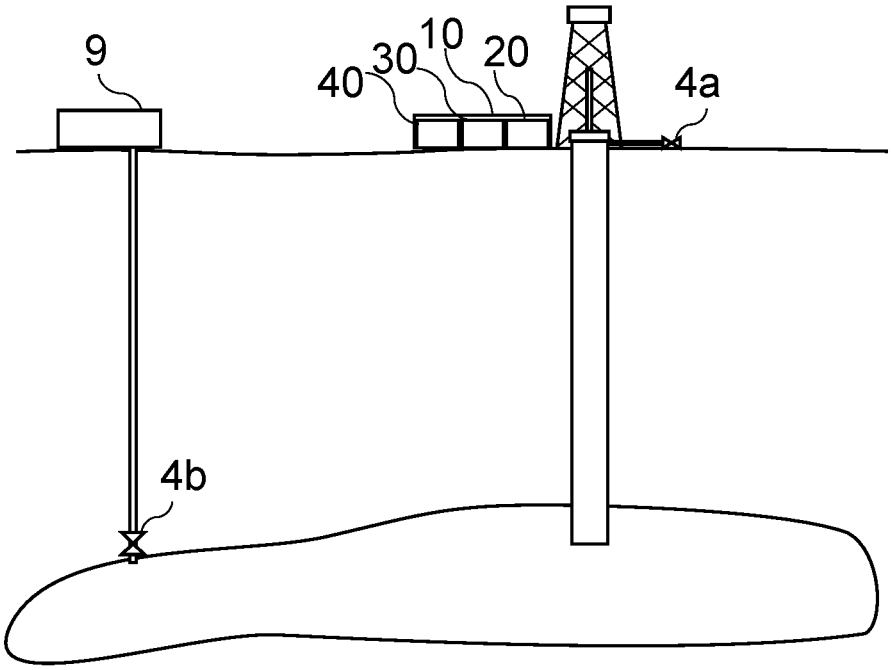
FIG. 2 shows a schematic of a system for improving the operation of a wellbore according to a second embodiment of the invention wherein the wellbore is coupled to an injection device.

Thus, as illustrated in FIG. 2, a wellbore 1 may be associated with a hydrocarbon enhanced recovery device 9 which comprises an injection valve 4*b*. The injection valve 4*b* allows a fluid to be injected into the reservoir, thus controlling at least part of the fluid 3 circulating in the drill pipe. The injected fluid can be, for example, water such as low salinity water, $CO_2$, or other gases, mixtures containing polymers (gel), or surfactants. This feature allows the creation of a pressure gradient in order to increase recovery rates and optimize yields for oil production wells. Indeed, the injected fluid displaces the hydrocarbons or more generally the fluid to be recovered. In the context of the invention, as will be detailed later, the volume of fluid injected can be controlled by the injection valve 4*b*. The device according to the invention is then configured to generate data for controlling the opening of the injection valve 4*b*, the output valve 4*a*, or the output valve 4*a* and the injection valve 4*b*.

Figure 3:
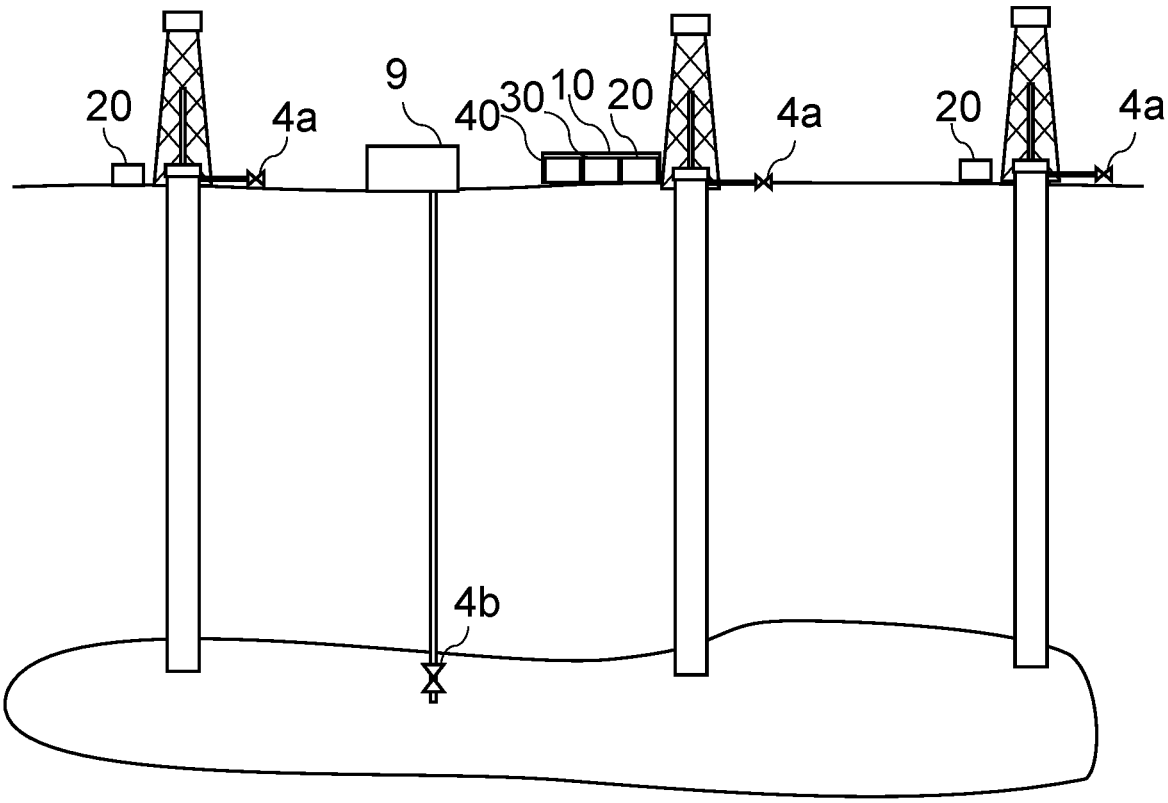
FIG. 3 shows a schematic of a system for improving the operation of a wellbore according to a third embodiment of the invention, wherein the system involves several wellbores coupled to an injection device.

Some reservoirs are exploited by several wellbores. Thus, in this context and as illustrated in FIG. 3, the device 10 according to the invention, in particular the optical device 20, can be arranged at the different wellbores of the reservoir so as to obtain distributed data for all the wellbores. In particular, according to this embodiment of the invention, the system according to the invention may comprise a plurality of optical devices 20, each in connection with a wellbore of the plurality of wellbores. In addition, a plurality of processing devices 30 in connection with each of the plurality of wellbores may be present. Preferably there is a single processing device 30.

In addition, in this type of reservoir the use of an enhanced oil recovery system 9 is frequent. Thus, the device 10 according to the invention will be able to control the opening of the injection valve 4*b* and/or the outlet valves 4*a* according to the pairs of digital backscatter signals obtained from each wellbore.

Figure 4:
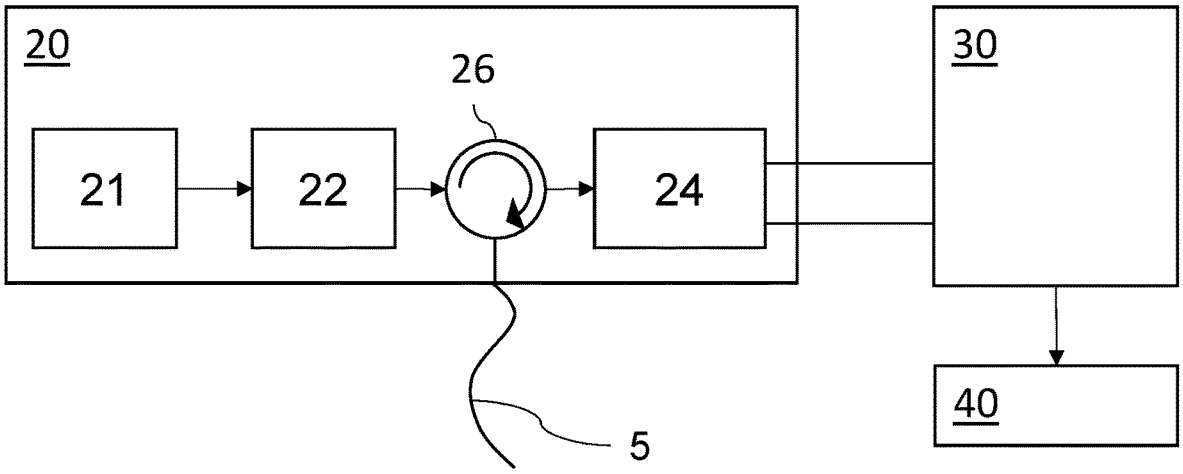
FIG. 4 shows a schematic of a device for improving the operation according to a first embodiment of the invention.

The device 10 for improving the operation of a wellbore according to the invention is particularly illustrated in FIG. 4. This comprises an optical device 20 configured to generate two digital orthogonal backscatter signals from a light signal, preferably polarized, injected into said optical fiber 5; a processing device 30 configured to generate, from the two digital orthogonal backscatter signals, data for controlling the opening of the outlet valve 4*a* and/or the injection valve 4*b*; and a regulating device 40 configured to control the opening of at least one injection valve 4*b* and/or outlet valve 4*a*. Advantageously, the regulating device 40 may also be configured to send a signal for closing the injection valve 4*b*.

The optical device 20 can take any form capable of generating two digital orthogonal backscatter signals. In particular, the optical device 20 may generate two digital orthogonal backscatter signals from a light signal, preferably polarized, injected into said optical fiber 5. In particular, the two digital orthogonal backscatter signals are generated from backscatter of one or more light signals, not propagating at the same speed. Preferably, the two digital orthogonal backscatter signals are derived from two backscatter light signals each having a component orthogonal to a component of the other signal and at least one of the two digital orthogonal backscatter signals is derived from a light signal having a single component. More preferably, the two digital orthogonal backscatter signals are derived from two light signals consisting essentially of one component orthogonal to the other signal component. In addition, in particular, one of the digital orthogonal backscatter signals is derived from a light signal having a single first polarization mode and the other digital orthogonal backscatter signal is derived from a light signal having a second polarization mode orthogonal to the first polarization mode. In addition, in particular, one of the digital backscatter signals is substantially derived from a light signal having a component orthogonal with respect to the other signal having substantially a component of the signal orthogonal to the essential component of the first signal.

The optical device 20 will typically include a light source 21, at least one polarization controller 22, at least one circulator 26, and at least one detector 24. In addition, it will be arranged to be connected to an optical fiber 5.

The light source 21 is preferably a pulse laser or a pulsed laser. The laser is configured to inject a light signal into the optical fiber 5 according to a predetermined wavelength. A light source 21 in one embodiment is a tunable laser configured to transmit coherent light over a wavelength range between about 1530 nm and 1565 nm. In other embodiments, any wavelength range between about 1300 nm and 1800 nm may be used. Furthermore, the light source can be configured to adjust or synchronize the duration of the light pulses and select the wavelength of the emitted light. In addition, a pulsed laser source can also correspond to a wave packet. A wave packet is the superposition of waves of various frequencies. Thus, it is also possible to use a plurality of frequencies to locate events.

At the output of the light source 21, the light signal is directed to a polarization controller 22.

The polarization controller 22 is configured to influence the polarization of the light signal. According to a particular embodiment of the invention, a polarization controller may correspond to a polarizer. In addition, a plurality or a single polarizer 22 may be present in the optical device 20. In this case, the polarizer 22 is configured to polarize the emitted light before it enters the optical fiber 5. Preferably, the polarizer 22 allows the light signal to be in a polarization state such that it has two orthogonal components. The light signal is preferably in a polarization state comprising the electromagnetic fields "P" and "S" such that the Hermitian scalar product of their respective vector is zero. In particular, several polarizers in series can be present at the output of the light source. The "P" and "S" fields correspond to laboratory marks, that is they are defined as axes with respect to a prism, with the "S" field corresponding to an orientation perpendicular to the plane of propagation and the "P" field to an orientation parallel to the plane of propagation. Thus, during deformation, the orientation of the axes is different, but the axes always remain orthogonal. Indeed, the fiber remains the local mark.

The polarized light signal from the polarizer is directed to the optical circulator 26.

The optical circulator 26 is configured to receive the polarized light signal from the polarizer. In addition, the optical circulator 26 is configured to inject the polarized light signal into the optical fiber 5. Finally, the circulator 26 is configured to collect backscatter, for example Rayleigh backscatter, from the optical fiber 5.

Thus, the light signal from the optical fiber 5, including backscatter (for example Rayleigh backscatter), is collected by the optical circulator 26 and then directed to the detector 24.

The detector 24 is for example configured to detect the backscattered light signal and to transform the light signal into a digital signal and preferably into two orthogonal backscattered digital signals. In addition, the detector 24 allows the absorbed light signal to be analyzed. Thus, the detector 24 may also be configured to measure characteristics of the signal, for example frequency, period, effective value. The detector 24 may also be configured to obtain the spectrum of the signal using Fourier Transform. The detector can also be used to decode digital signals such as USB, LIN, CAN. The detector can be used to display the results.

According to a particular embodiment, the optical device 20 may be portable, allowing it to be easily and quickly transported to any location in the vicinity of a wellbore.

The two digital orthogonal backscatter signals from the detector 24 are advantageously directed to the processing device 30.

There are a large number of possible optical arrangements within the optical device 20. Hereinafter, some of these arrangements, which are particularly advantageous in the context of the invention, shall be described without the invention being limited thereto.

Figure 5:
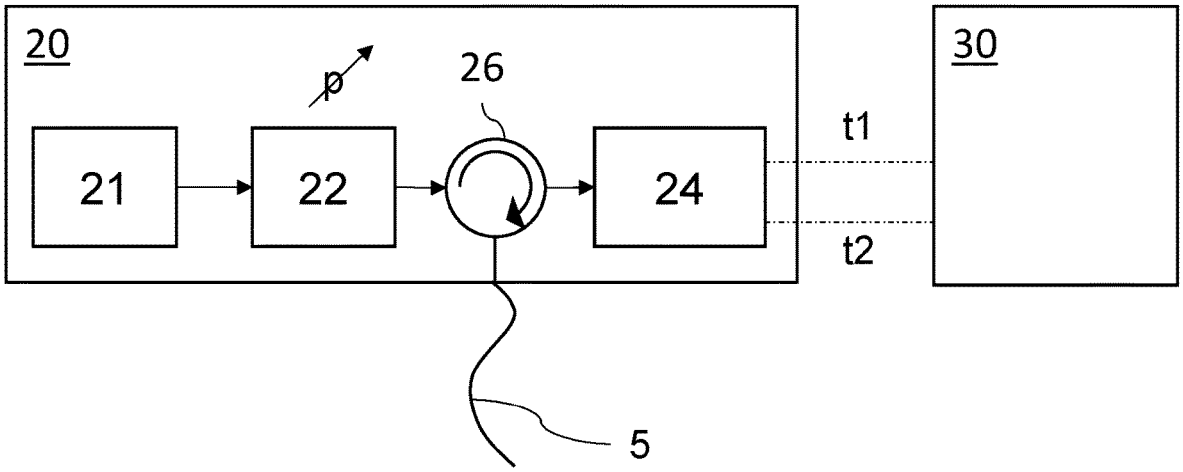
FIG. 5 shows a schematic of a device for improving the operation according to a second embodiment of the invention.

Thus, according to a particular embodiment, illustrated in FIG. 5 the polarization controller 22 may be a polarization modulator. The polarization controller 22, in the form of a polarization modulator, is adapted to, preferably configured to, adjust the polarization of the light as a function of time. According to a particular embodiment of the invention, only one polarization modulator may be present in the optical device 20. In this case, the polarization modulator is configured to polarize the light beam before it enters the optical fiber 5. Preferably, the polarization modulator dynamically allows a modulation of the polarization of the light signal, that is to say, it dynamically modulates the polarization state of the light signal before it enters the fiber.

Thus, the polarization modulator is adapted to, preferably configured to, polarize the light signal so that it is in a polarization state according to an electromagnetic field "P". The polarization modulator also polarizes the light signal so that it is in a polarized state according to an electromagnetic field "S". Preferably, the modulation of the polarization state is done one by one, that is to say the light signal is modulated according to an electromagnetic field "P" or "S" independently of each other as a function of time. However, it does not matter which modulation state is achieved first versus second. For example, a first modulation of the polarization according to the electromagnetic field "P" is performed until its signal is detected, and then the second modulation of the polarization according to the electromagnetic field "S" is performed until its signal is detected.

In particular, once the light signal is detected according to the first polarization field, the polarization modulator 22 is configured to modulate the light signal according to the second electromagnetic field different from the first detected one. When this second light signal is detected, the two light signals are analyzed according to their "P" or "S" polarization state. Their analysis can be done independently of each other.

The light signal is therefore in a polarization state comprising either the "P" or the "S" electromagnetic field.

In this embodiment the detector 24 detects a first light signal and then a second light signal according to their electromagnetic field. The detector 24 transforms the first light signal into a first digital signal, for example t1, which is then sent to the processing device 30. With the first light signal being the first light signal detected. The detector 24 transforms the second light signal into a second digital signal, for example t2. The second light signal corresponds to the second detected light signal.

Figure 6:
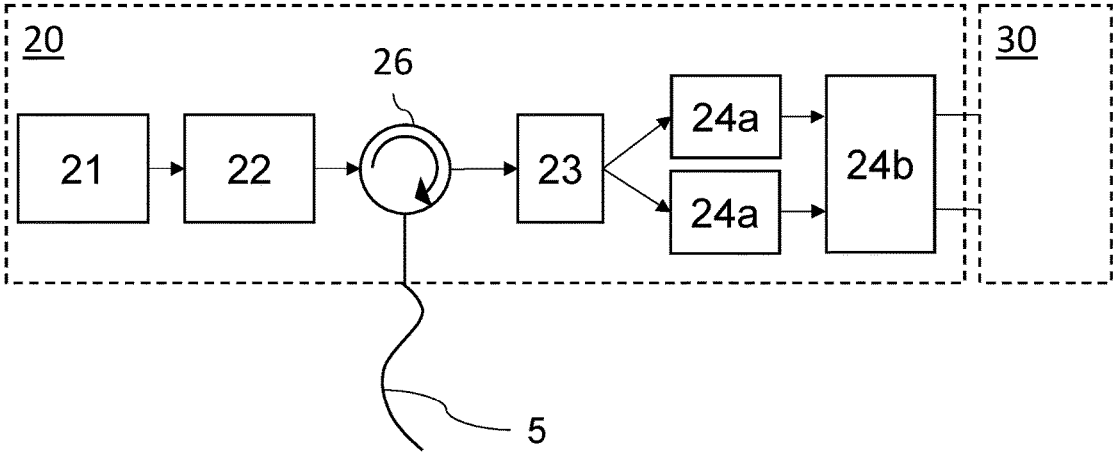
FIG. 6 shows a schematic of a device for improving the operation according to a third embodiment of the invention.

According to a particular embodiment, illustrated in FIG. 6 the optical device 20 comprises a polarized splitter 23.

The polarized splitter 23 is configured to split and separate the light beam comprising the "P" and "S" fields into two signals each having a polarization orthogonal to the polarization of the other signal. The light beam from the optical fiber is split into a light beam comprising the "P" field and a light beam comprising the "S" field. This separation is done in such a way that the light beam is divided according to the polarization state. The two orthogonally polarized light beams are each sent to a detector 24. Preferably, a polarized splitter 23 is selected from: polarizing splitter cubes consisting of two right-angle prisms, fused fiber polarization splitters ("fused fiber polarization splitters", in Anglo-Saxon terminology), etc.

The detector 24 may include at least one detector module 24*a*. This detection module 24*a* is, for example, configured to transform and convert a light signal into an electric current or voltage. This detection module 24*a* may correspond to a single or multiple photodetector. Preferably, it is a simple photodetector. The detector 24 preferably comprises two detector modules 24*a*, so that two electrical signals are obtained.

The electrical signals from the detection module 24*a* are directed to a digitizer module 24*b*.

The digitizer module 24*b* is preferably configured to transform and convert the two electrical signals into two digital orthogonal backscatter signals. This digitizer module 24*b* may correspond, for example, to an oscilloscope or any other means for transforming two electrical signals into two digital signals.

The detector modules 24*a* and the digitizer module 24*b* may be independent or may be included in a same assembly.

Furthermore, the detector 24 may preferably include a storage module configured to store collected data of electrical signals, digital signals.

Figure 7:
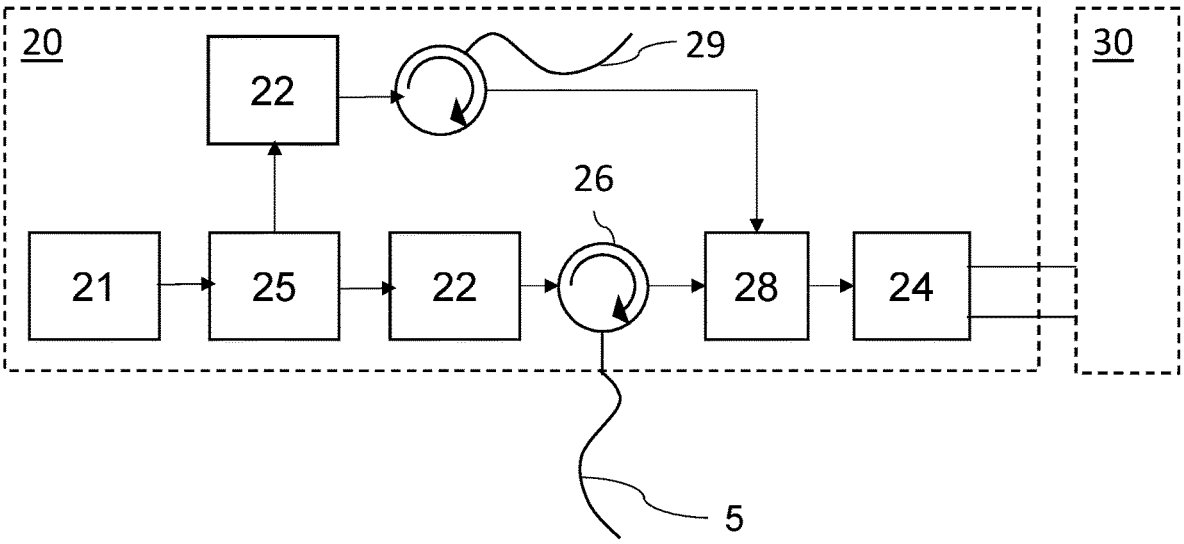
FIG. 7 shows a schematic of a device for improving the operation according to a fourth embodiment of the invention.

According to another embodiment illustrated in FIG. 7, the optical device 20 may include a reference fiber 29.

In this case, the light source 21 is continuous and frequency tunable. Preferably, the light source can be tuned to a wide frequency band. It can be a frequency scanning laser, for example.

At the output of the light source 21, a beam splitter 25 allows the light signal to be directed, on the one hand, towards a reference path, towards the entry of the reference fiber 29 and, on the other hand, towards a test path, towards the entry of the optical fiber 5. A beam splitter 25 may correspond to a connector, mirror, lens for directing the light signal in a desired direction. This can be any means, preferably optical, configured to divide and direct the light signal.

Each beam is directed to a polarization controller 22. Preferably, the polarization controller 22 may correspond to a polarizer. Thus, a polarizer 22 allows the beam to be polarized towards the reference fiber 29 and a polarizer 22 allows the beam to be polarized towards the test fiber 5. The polarizers 22 are configured to polarize the light beam of the reference fiber 29 and the optical fiber 5.

In addition, the presence of polarizers following the beam splitter 25 allows for the same polarization for each beam whether it is for the test fiber or the reference fiber.

The light signal passing through the reference fiber and the optical fiber 5 is then directed at the output of the reference fiber and of the optical fiber 5 to a coupler 28. Preferably, the reference path comprises a delay component. This path is preferably a lossless optical transmission. However, it does not have to be perfectly lossless.

The coupler 28 is configured to couple the light signal from the optical fiber 5 with the light signal from the reference fiber 29. Thus, at the output of the reference fiber and at the output of the optical fiber 5, the coupler 28 is configured to interfere the light signal from the reference fiber 29 with the light signal from the optical fiber 5. This light signal combination is then directed to the detector 24.

Optionally, following the coupler 28, the light signal may be directed to a polarized splitter 23, then each light signal may be directed to a detection module 24*a*, and then a digitizer module 24*b* for further processing by the processing device 30.

In particular, the processing device 30 may be configured to process the two digital orthogonal backscatter signals so as to, for example, derive wellbore optimization actions or recovery rates. Preferably, when the signals are processed, the processing device 30 allows data to be obtained, as a function of distance, proportional to the transverse pressure. Thus, it is possible to obtain a distributed pressure profile of the wellbore over the entire distance of the wellbore.

The analysis may be performed by the processing device 30 in a distributed manner, but also in real time. Thus, the pressure of a wellbore can be mapped in real time and at any point. In addition, the data is preferably stored on a storage module. This allows all the wellbore measurements, all the data collected by the optical fiber, and all the digital signals to be saved.

In particular, the processing device 30 may be configured to calculate values of fluid circulation parameters from the two digital orthogonal backscatter signals. The processing device 30 is preferably configured to calculate pressure values, preferably distributed pressure values, from the two digital orthogonal backscatter signals.

Advantageously, the processing device 30 may be configured to identify areas of pressure criticality. Preferably, the processing device 30 is also configured to compare the intensity ratio as a function of distance with the measured output as a function of time. This makes it possible to determine criticality areas correlated with production variations.

In addition, the device 10 for improving the operation of a wellbore may include a regulating device 40.

The regulating device 40 allows the opening of the injection valve 4*b* and/or the output valve 4*a* depending on the two digital backscatter signals to be controlled. More particularly, the regulating device 40 may be configured to control the opening of the injection valve 4*b* and/or the outlet valve 4*a* depending on the values of fluid circulation parameters calculated by the processing module 30.

Thus, depending on the value of the signals or the calculated fluid circulation parameters, the opening or closing of at least one valve can be implemented to increase the production and exploitation of a wellbore or to increase the recovery rate or to stabilize the pressure. It is therefore feedback on the control of the fluid circulation according to the distributed pressure measurements made by two digital orthogonal backscatter signals. This is particularly advantageous since the invention allows a feedback loop to be achieved by taking advantage of the upstream information (pressure measurements) in order to control fluid circulation.

Thus, the invention allows, thanks to the information contained in the two digital orthogonal backscatter signals, access to the pressure distributed all along the fiber and thus the well to control fluid circulation.

Figure 8:
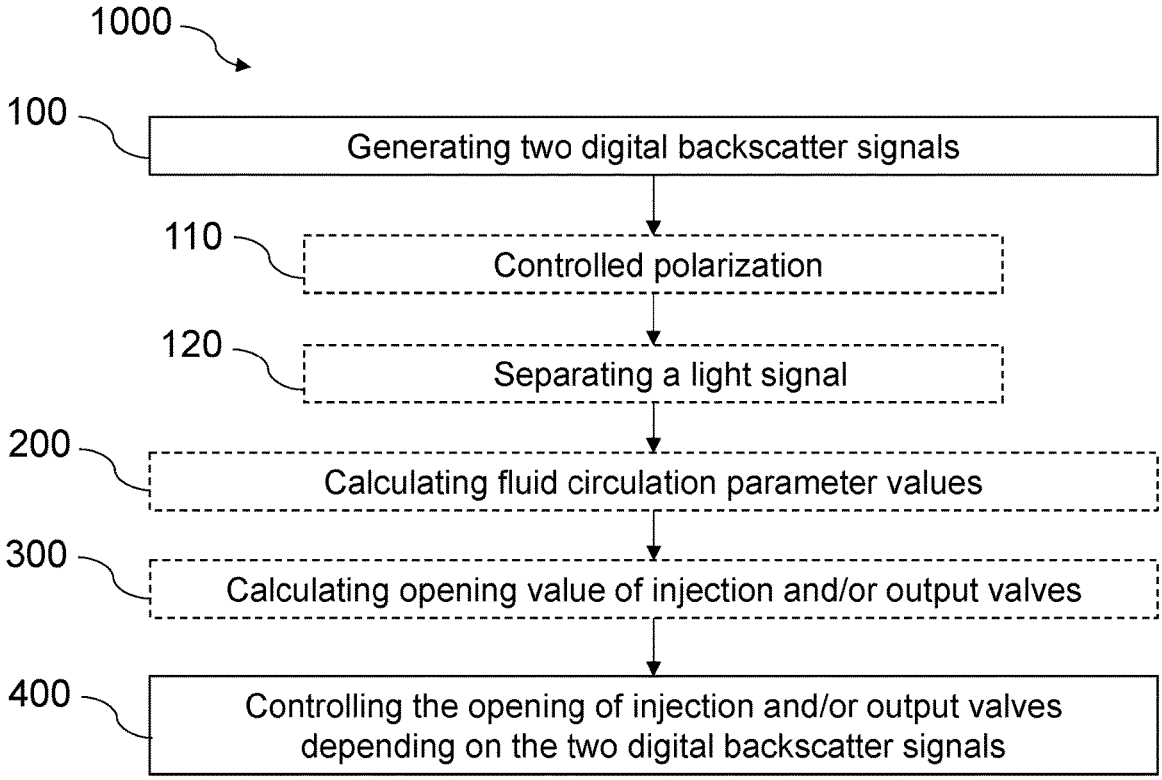
FIG. 8 shows a schematic of the different steps of the method of improving the operation of a wellbore according to an embodiment of the invention. The steps in dotted boxes are optional.

According to another aspect, the invention relates to a method 1000 of improving the operation of a wellbore as shown in FIG. 8.

According to a preferred embodiment illustrated in FIG. 8, the method comprises a step of generating 100 two digital orthogonal backscatter signals from a light signal, preferably polarized, injected into said optical fiber.

To this end, the generation step preferably comprises a light source configured to emit a light signal that is directed to the optical fiber. Preferably, the light source is a pulsed laser.

Advantageously, the generation step 100 includes a step 110 of controlled polarization of a light signal injected into the optical fiber. The polarization control step is performed using a polarizer or a polarization modulator, preferably by a polarizer. The polarizer is configured to condition the polarization of the transmitted light signal before the light signal enters the optical fiber. In particular, the polarization step 110 allows the energy distributed between the two main polarization modes of the single-mode optical fiber to be balanced. Thus, to increase the sensitivity of the method according to the invention, the intensity of the light signal is substantially balanced for the P-component and for the S-component at the output of the detection through the polarization control and the polarization beam splitter (PBS, in English, polarization beam splitter) axis, when present.

Also in particular, the method may comprise a step of circulating the light signal. The circulation step is preferably performed by a circulator. This allows, on the one hand, to inject the polarized light signal into the optical fiber, and, on the other hand, to collect the backscattered signal from the optical fiber. The backscattered signal is preferably derived from Rayleigh backscatter.

The generation step 100 preferably includes a step 120 of separating a backscatter signal into two orthogonal backscatter light signals. The separation step is preferably performed by a polarization beam splitter. This allows the backscattered light beam comprising the "P" and "S" fields to be separated. The backscattered light beam from the optical fiber is split into a backscattered light beam comprising the "P" field and a light beam comprising the "S" field. This separation is done in such a way that the light beam is divided along the eigenaxes of the polarization beam splitter. The two orthogonally polarized light beams are each sent to a detector. Alternatively, the light signal injected into the optical fiber can be successively polarized according to the "P" electromagnetic field and then according to the "S" electromagnetic field, for example by means of a polarization modulator. Thus, it is not necessary to separate the backscatter signal into two orthogonal backscatter light signals.

In a detailed exemplary implementation of birefringence determination, the intensity of reflected light from a fiber resulting from Rayleigh backscatter is measured. The measured light intensities for the "S" and "P" polarization modes (defined by the polarization beam splitter axes) are then converted to the accumulated phase shift between the two main propagation modes. The distributed birefringence, as a function of distance along the optical fiber, is then calculated by a derivative with respect to the propagation distance in the fiber.

In addition, as illustrated in FIG. 8, the method may comprise an intermediate step of calculating 200 values of fluid circulation parameters from the two digital orthogonal backscatter signals. The intermediate calculation step 200 includes calculating distributed pressure values of the fluid circulating through the tube from the two digital orthogonal backscatter signals.

This step is preferably carried out by any means allowing the calculation of parameter values from digital signals. For example, a computing module, which may for example comprise a processor configured to extract information from the data contained in the digital backscatter signals. In particular, this step may be performed by the processing device 30.

The fluid circulation parameters can be calculated at any point along the fiber, per fiber segment, or for the entire fiber length. The fluid circulation parameters of the fluid are preferably selected from: the distributed pressure, the pressure average, the pressure median, the pressure variation, the integral, or the derivative. Advantageously, the calculation method used allows the analysis to be carried out continuously point by point without averaging the data and therefore increases the resolution.

Preferably, the calculation of distributed pressure values of the fluid circulating through the tube comprises calculating an optical signal intensity ratio as a function of distance. This calculation step allows pressure criticality areas to be identified. Preferably, this calculation step includes comparing the intensity ratio as a function of distance with the detected pressure as a function of time. This allows the determination of distributed pressure variations and the precise determination of criticality areas. Furthermore, this makes it possible to correlate the production of the wellbore with the pressure delivered. In particular, the optical signal intensity ratio corresponds to a ratio based on the measured light intensities for the "S" and/or "P" polarization modes. In addition, the calculation of distributed pressure values of the fluid circulating through the tube may also include calculating a variance of the optical signal intensity ratio for a segment of the tube as a function of time. This also allows the identification of areas of pressure criticality.

Figure 9:
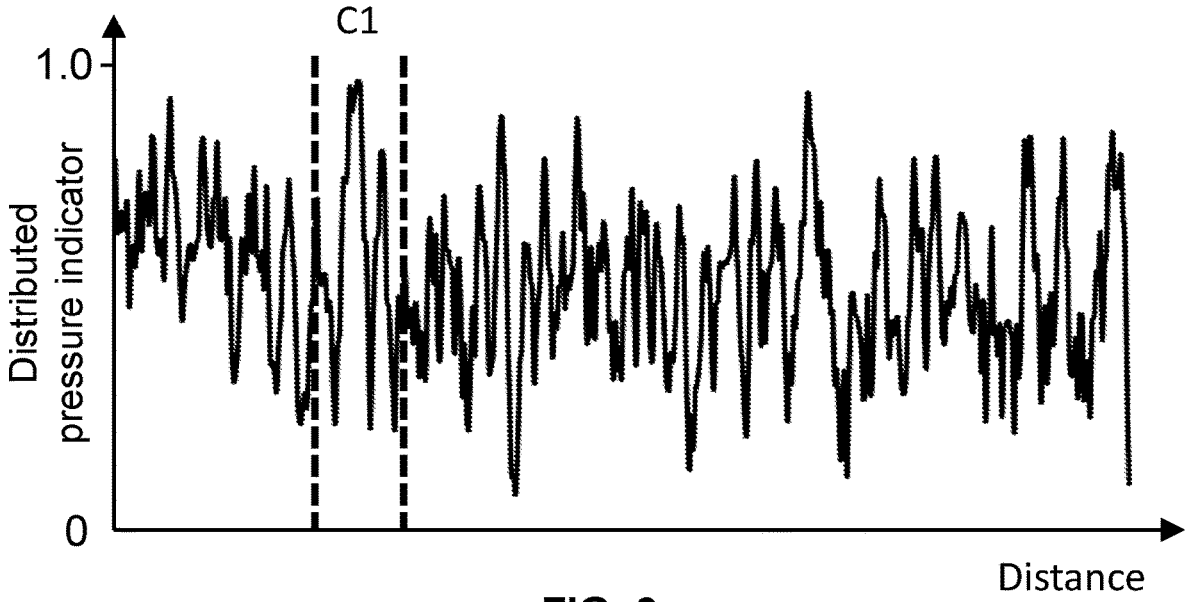
FIG. 9 shows a graph illustrating normalized values of pressure indicators as a function of distance in the optical fiber obtained in a method of improving the operation of a wellbore, and identifying a critical pressure zone C1.

For example, FIG. 9 shows normalized values of the distributed pressure as a function of distance along the optical fiber. Such an indicator may, for example, be a ratio of the light intensity, an average of the pressure, a variability of the pressure according to a coefficient of variation of pressure, or any other parameter allowing the pressure to be characterized as a function of distance, preferably in meters. For example, in the case of an intensity ratio, the light signal from the "P" polarization state yields a digital signal, the Rayleigh backscattering light intensity of which is denoted as $I_p$, and the light signal from the "S" polarization state yields a digital signal, the Rayleigh backscattering light intensity of which is denoted as $I_s$.

More precisely, for example according to FIG. 9, the generation of two digital orthogonal backscatter signals from a light signal injected into the optical fiber allows a pressure indicator and preferably a distributed pressure indicator to be obtained. Preferably, the injection can be performed at a polarization angle of 45° with respect to the slow and fast axis of the optical fiber. The ratio $(I_p/(I_p+I_s))$ allows information about the pressure in the wellbore, preferably the distributed pressure, at any point in the wellbore and in real time, to be obtained. Such a report allows information to be obtained on the pressure distributed within the wellbore without the need to calculate a precise distributed pressure. Alternatively, this ratio, coupled with reference data, can be used to accurately calculate distributed pressure values. For example, the ratio of the backscattered intensity allows the accumulated delay (or phase shift) to be calculated and measured. Then, the derivative of the accumulated delay with respect to the propagation distance in the optical fiber allows the distributed birefringence to be obtained, which is proportional to the distributed pressure (corresponding to the lateral stress on the fiber).

In addition, an indicator of the pressure, and preferably of the distributed pressure, allows the detection of one or more criticality areas C1 as shown in FIG. 9. Preferably, the method according to the invention includes identifying several criticality areas.

Preferably, all the results or values obtained during the calculation step or the collection step are stored on a storage module at the end of each calculation or collection step. This allows for data storage as well as monitoring of wellbore operation, wellbore pressure.

Figure 10:
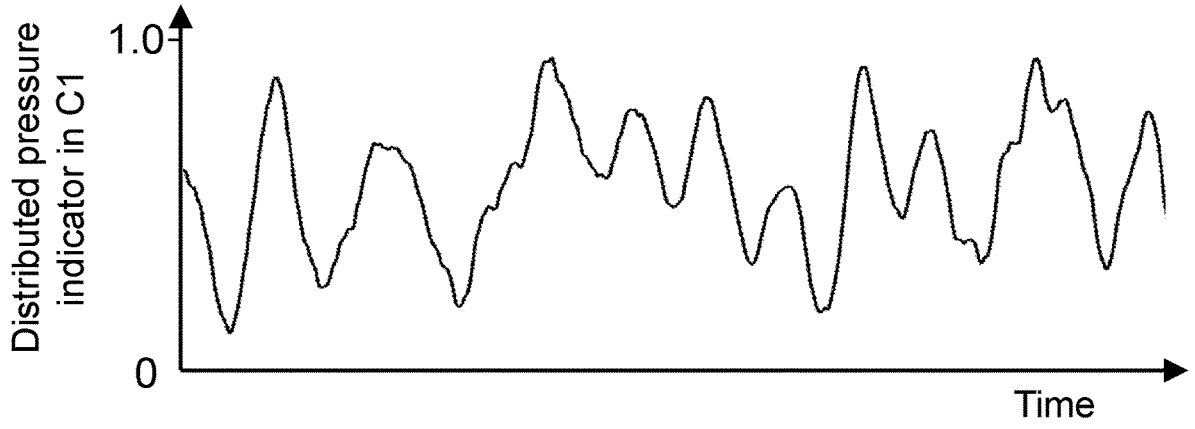
FIG. 10 shows a graph illustrating normalized pressure indicator values for a critical zone C1 as a function of time obtained in a method of improving the operation of a wellbore.

In particular, FIG. 10 shows normalized values of pressure in a criticality zone C1 over time. Thus, it is possible to see a strong variation of this pressure as a function of time.

Figure 11:
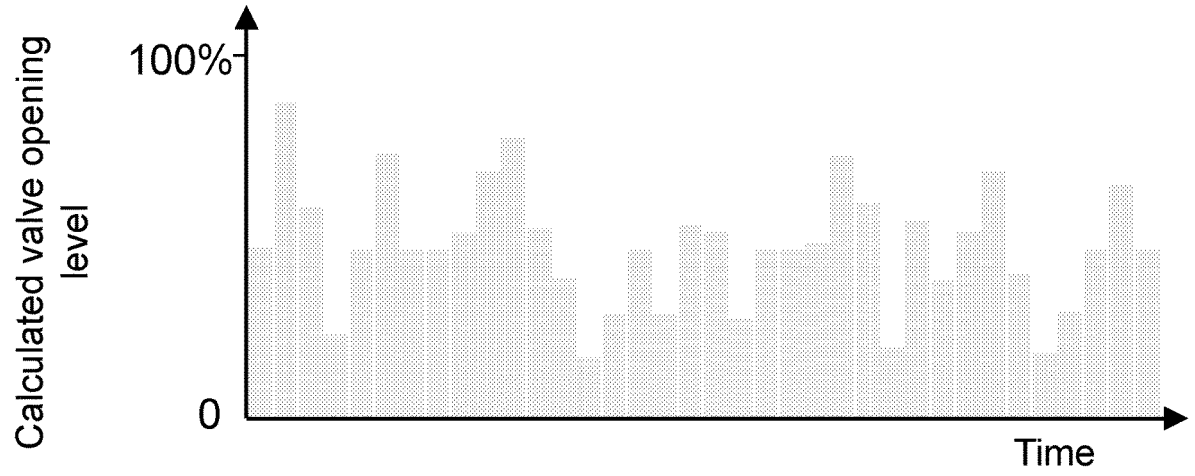
FIG. 11 shows a graph illustrating outlet valve control values, in opening percentage, obtained in a method of improving the operation of a wellbore according to the invention.

The method according to the invention may then include a step 300 of calculating the opening value of injection and/or outlet valves depending on the previously calculated fluid circulation parameters. FIG. 11 illustrates, for example, the calculated opening values of an outlet valve 4*a*, in the context of a wellbore as illustrated in FIG. 1 undergoing pressure variations in the criticality zone C1 according to FIG. 10. Indeed, as illustrated in FIG. 11, the information is correlated with indications of opening or closing at least one valve. For example, depending on the two digital signals, the processing module 30 allows the generation of output valve opening control data as a function of time. This (these) calculated outlet valve opening level(s) is (are) used to compensate for particular pressure data, in order to improve or optimize wellbore operation and increase wellbore production. Preferably, all of this data is saved by the storage module.

These values can then be transmitted to a device or to an operator who will transcribe them for example via a human-machine interface so that a control of the opening of the valves is generated.

Indeed, the method according to the invention advantageously comprises a step of controlling 400 the opening of injection and/or output valves depending on the two digital backscatter signals. Preferably, the control step is implemented by a regulating device 40. This makes it possible to modify the opening or closing of at least one valve according to the values of the digital signals representative of the distributed pressure. This also makes it possible to modify the opening or closing of at least one valve to increase production from a wellbore, to improve operations. In addition, this makes it possible to stabilize production and pressure depending on digital backscatter signals.

The valve opening control step 400 is preferably carried out depending on the distributed pressure values from the two digital backscatter signals. In particular, the valve opening control step 400 may be carried out depending on the valve opening values calculated in step 300. Nevertheless, the valve opening control step 400 may also be carried out by comparing the two digital backscatter signals to predetermined threshold values.

The control step 400 may include outputting a control signal for opening at least one valve and sent to said valve. This allows for increased wellbore production and improved operation. In addition, this makes it possible to stabilize production and pressure depending on digital backscatter signals.

The valve opening control step 400 is advantageously carried out depending on the circulation parameters obtained from the two digital backscatter signals. For example, when a value of one of the circulation parameters from the two digital backscatter signals is different from the circulation parameter values calculated from the two stored digital backscatter signals, a signal for controlling the opening of at least one valve is sent to said valve. This allows for increased wellbore production and improved operation. In addition, this makes it possible to stabilize production and pressure depending on digital backscatter signals.

The control step 400 may also include sending a signal for closing an injection valve.

The method may optionally comprise an alerting step. The alerting step allows to trigger an alarm when an abnormal pressure is detected, an abnormal parameter is detected, or when a corrective action (opening or closing of at least one valve) is carried out. This allows the operators to be alerted to the status of the wellbore and the progress of the method.

Figure 12:
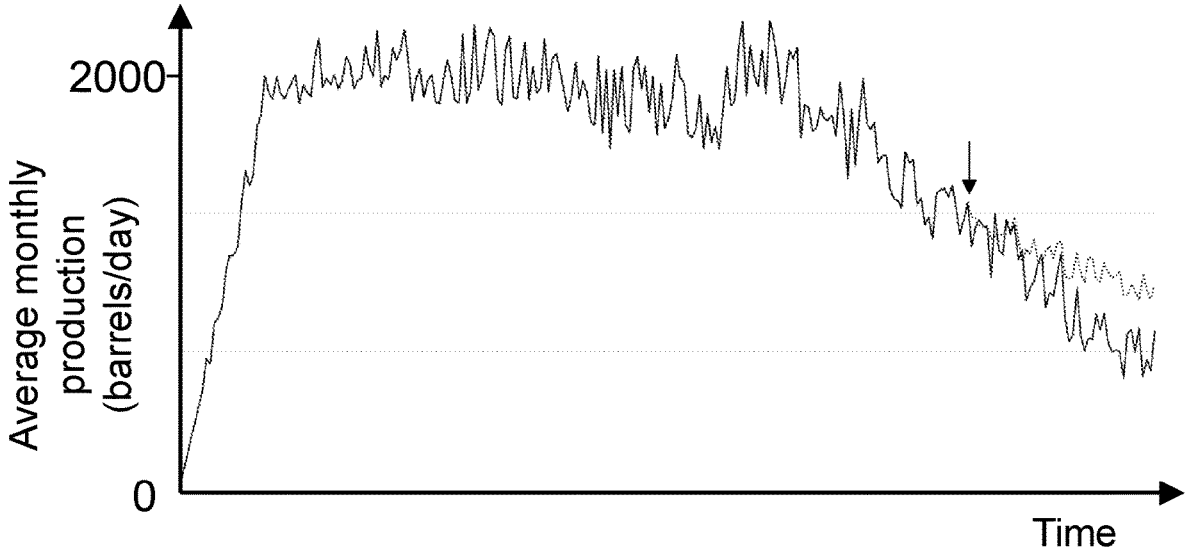
FIG. 12 shows a graph illustrating average monthly production values over 20 years in barrels per day for a wellbore that has or has not implemented the method according to the invention. The arrow indicates the start of the implementation of the method and the dotted curve the expected recovery values.

As shown in FIG. 12, the monthly production from January 1998 to December 2018 of barrels per day over time for a wellbore may experience an increasing performance early in its life cycle and then a plateau phase. With the production decreasing over time once the plateau phase is over. However, using the invention and its implementation (represented by a black arrow in FIG. 12), it is possible to increase and optimize the production of the wellbore (dotted line in FIG. 12).

It is thus possible to obtain a model of the fluid movements and to deduce pressure variations therefrom as a function of distance and/or time. According to the analysis of the digital orthogonal backscatter signals obtained, pressure variations are observed. This leads to corrective or stabilizing pressure measures and control of the injection or discharge of fluid into the reservoir. This allows the operation of a wellbore to be improved, the pressure of a wellbore to be stabilized, and the production of a wellbore to be increased. In addition, this allows early wellbore closure to be avoided while increasing recovery rates.

According to another aspect, the invention relates to a device for improving the operation of a wellbore. The system may comprise a device 10 for improving the operation of a wellbore 1 according to the invention and as previously described. In addition, the system may comprise a regulating device 40 configured to control the opening of the injection valve 4*b* and/or output valve 4*a* depending on the generated opening control data. This also allows for pressure stabilization and fluid flow regulation, which in turn increases the life of the infrastructure and optimizes well performance.

This system makes it possible to use the information generated via the optical fiber to stabilize and regulate the flow of a fluid, especially when the wellbore conditions are little or not known. In addition, this system eliminates unstable or not very stable pressure oscillations along the length of the well, which can be detrimental to the well and even lead to early closure.

Advantageously, the system comprises at least one valve configured to control the circulation of the fluid 3. Indeed, when the wellbore is in the decline phase, or when the production decreases or when the wellbore is unstable, the opening of at least one valve allows the injection of, for example, gas, water in a liquid or gaseous state to stimulate the expulsion of the fluid 3 contained in the drill pipe. This allows for increased production or stabilization of the wellbore. In addition, using the system according to the invention, the components injected into the drill pipe and the fluid 3 contained in the drill pipe are more easily separated. Indeed, the injection of gas or water into the drill pipe leads to mixing with the fluid 3 contained in the drill pipe. The subsequent separation of the components is therefore optimized because, thanks to the analysis of the distributed pressure and the criticality areas, there is a better control of the ratio of contained fluid 3/injected fluid. Indeed, these values must be within a particular and specifically determined range for the subsequent separation during purification to be effective.

The invention claimed is:

1. A method of improving operation of a wellbore, said wellbore including a drill pipe in which a fluid circulates and an optical fiber positioned outside the drill pipe, the circulation of said fluid being controlled at least in part by at least one of an outlet valve or an injection valve, said method including the steps of:

generating two digital orthogonal backscatter signals from at least one light signal injected into said optical fiber, calculating values of fluid circulation parameters, including an optical signal intensity ratio as a function of distance, from the two digital orthogonal backscatter signals, and controlling opening of at least one of said at least one outlet valve or injection valve depending on distributed pressure values calculated from the two digital orthogonal backscatter signals, and on said fluid circulation parameters.

2. The method according to claim 1, wherein the calculating step includes calculating distributed pressure values of the fluid circulating in the drill pipe from the two digital orthogonal backscatter signals, and in that the step of controlling the opening of at least one of said at least one outlet valve or said injection valve is carried out depending on the distributed pressure values obtained from the two digital backscatter signals.

3. The method according to claim 1, wherein the calculating step includes comparing the intensity ratio as a function of distance with detected pressure as a function of time.

4. The method according to claim 3, wherein the calculating step includes calculating a variance of the optical signal intensity ratio for a segment of the drill pipe as a function of time.

5. The method according to claim 1, wherein the generating step includes a step of controlled polarization of a light signal intended to be injected into the optical fiber.

6. The method according to claim 1, wherein the generating step includes a step of separating a backscatter signal into said two orthogonal backscatter signals.

7. A device for improving operation of a wellbore, said wellbore comprising a drill pipe in which a fluid circulates and an optical fiber positioned outside the drill pipe, said device for improving the operation of a wellbore being coupled to at least one outlet valve or injection valve, wherein the circulation of said fluid is controllable at least in part by said at least one outlet valve or injection valve, said device for improving the operation of a wellbore further comprising:

an optical device configured to generate two digital orthogonal backscatter signals from a light signal injected into said optical fiber, and a processing device configured to generate, from distributed pressure values and fluid circulation parameters including an optical signal intensity ratio as a function of distance calculated from the two digital orthogonal backscatter signals, opening control data of the outlet valve or of the injection valve to control opening of the outlet valve or the injection valve.

8. The device according to claim 7, wherein the optical device is arranged at the wellbore.

9. The device according to claim 7, configured to control the outlet valve and/or the injection valves of several wellbores.

10. The device according to claim 7, wherein the optical device includes a light source, at least one polarization controller, at least one circulator, and at least one detector.

11. The device according to claim 10, wherein the circulator is configured to collect backscatter from the optical fiber.

12. The device according to claim 10, wherein the detector is configured to detect backscattered light from said light signal and to transform the light signal into said two digital orthogonal backscatter signals.

13. The device according to claim 12, said backscattered light comprising a first backscattered light signal and a second backscattered light signal, wherein the detector is configured to detect the first backscattered light signal and then the second backscattered light signal according to their respective electromagnetic fields, and to transform them respectively into said two digital orthogonal backscatter signals.

14. The device according to claim 10, wherein the detector comprises at least one detector module configured to transform and convert the light signal into two electrical signals; said electrical signals being directed to a digitizer module configured to transform and convert the two electrical signals into said two digital orthogonal backscatter signals.

15. The device according to claim 7, wherein the optical device comprises a polarized splitter configured to divide and separate the light signal into a first light beam comprising a "P" field and a second light beam comprising a "S" field, each of the first and second light beams being polarized orthogonal to one another.

16. A system for improving operation of a wellbore, comprising the device for improving the operation of a wellbore according to claim 7, and a regulating device configured to control the opening of the injection valve and/or the outlet valve depending on the generated opening control data.

17. The system for improving the operation of a wellbore according to claim 16, wherein the system comprises a plurality of optical devices, each in connection with one of a plurality of wellbores.

18. The system according to claim 16, wherein the system controls injection and/or outlet valves of several wellbores.

* * * * *